US007112144B2

(12) United States Patent
Mindlin

(10) Patent No.: US 7,112,144 B2
(45) **Date of Patent: *Sep. 26, 2006**

(54) METHOD AND APPARATUS FOR GOLF INSTRUCTION

(76) Inventor: Richard B. Mindlin, 4101 W. 90th St., Shawnee Mission, KS (US) 66207-2325

( * ) Notice: Subject to any disclaimer, the term of this patent is extended or adjusted under 35 U.S.C. 154(b) by 0 days.

This patent is subject to a terminal disclaimer.

(21) Appl. No.: 10/684,609

(22) Filed: Oct. 14, 2003

(65) Prior Publication Data

US 2004/0077430 A1 Apr. 22, 2004

Related U.S. Application Data

(62) Division of application No. 09/915,141, filed on Jul. 25, 2001, now abandoned.

(51) Int. Cl.
*A63B 57/00* (2006.01)
*A63B 69/36* (2006.01)

(52) U.S. Cl. ..... 473/218; 473/267; 473/270

(58) Field of Classification Search ..... 473/270, 473/225, 279, 217, 218, 206, 201, 207, 210, 473/211, 219, 228, 240, 266, 267, 268, 278, 473/285; 434/252, 218, 270, 267
See application file for complete search history.

(56) References Cited

U.S. PATENT DOCUMENTS 4,164,352 A * 8/1979 O'Brien ..... 473/218
5,141,232 A * 8/1992 Durso ..... 473/270
5,294,124 A * 3/1994 Florian ..... 473/267
5,839,968 A * 11/1998 Latella ..... 473/219
6,500,075 B1 * 12/2002 McDevitt ..... 473/272

* cited by examiner

*Primary Examiner*—Eugene Kim
*Assistant Examiner*—M. Chambers
(74) *Attorney, Agent, or Firm*—Lathrop & Gage LC

(57) ABSTRACT

A golf instructional device is provided for designating proper setup positioning for swinging a golf club and for monitoring the location of a user's eyes while swinging the club, such a mat being customized for an individual golfer. The device comprises a mat for providing a playing surface upon which foot positioning markers, a club positioning marker and a mirror are placed. The markers and mirror are designed to be removably attached to the mat surface to allow a golf instructor to indicate proper location and angle for the user to position themselves and the club which they are swinging. The mirror is of a chosen size such that when attached to the mat at the proper location, the user can observe their eyes while swinging the golf club. A wedge is also provided to be positioned underneath a portion of the user's rearward foot to train the user to maintain a near stationary rear leg during the backswing. The user stands on top of the mat surface and aligns their feet with the foot positioning markers, aligns a golf club with the club positioning marker, and positions their body such that essentially only their eyes are viewable in the mirror. When the user makes practice swings the golf club, excessive lateral and vertical motion can be observed in the mirror.

12 Claims, 3 Drawing Sheets

METHOD AND APPARATUS FOR GOLF INSTRUCTION

RELATED APPLICATIONS

This application is a divisional application of U.S. patent application Ser. No. 09/915,141, filed Jul. 25, 2001 now abandoned, entitled METHOD AND APPARATUS FOR GOLF INSTUCTION the disclosure of which is incorporated hererin by reference.

BACKGROUND OF THE INVENTION

1. Field of the Invention

This invention relates generally to methods of teaching and devices for improving a golfer's skill and ability, and more specifically, for designating proper setup position for swinging a golf club and for monitoring the position of a user's head during swinging of the club.

2. Description of the Related Art

Golf is a sport that has become exceedingly popular all over the world. It is estimated that about two million people in the United States alone take up the game of golf every year. However, about as many people leave the game each year, largely because they are disappointed and frustrated over their inability to improve their golf technique. It is generally believed by leading golf instructors that it is difficult to improve at golf because (a) the essential fundamentals of a good golf swing feel unnatural to our bodies, (b) all natural instincts of students are absolutely wrong, (c) correct habits must be practiced over and over again to develop new and correct habits ("muscle-memory") and (d) while practicing to develop new muscle-memory, students must not be practicing bad habits that result in bad muscle-memory that will eventually have to be unlearned. As generally believed by leading instructors, bad muscle-memory is harder to unlearn than it is to learn good muscle-memory from the start.

To improve their abilities, many golfers take lessons from professional golf instructors. Although such lessons can teach an individual the fundamental skills needed to play the game, these golfers are most often not able to improve their golf club swing as much as desired because of a lack of guidance when practicing outside of the instructional setting. Most often students practicing without an instructor revert to, and practice, what feels natural but is in reality bad technique, thereby developing bad muscle-memory. As an alternative to lessons, self-instruction devices have been developed to allow golfers to improve their game by themselves. This approach has a downside in that such devices must be used in the proper fashion to create positive results, which is often difficult for a beginning or high handicap golfer who may have already developed bad habits. Further, even if used properly, these devices are often not proven to aid in proper development of a golfer's club swing technique because, as believed by leading instructors, golf is not a sport that can be self-taught; only with good coaching can the naturally wrong instincts be replaced with the correct fundamentals that initially feel instinctively wrong.

Finally, a deficiency with both professional lessons and self-instruction devices is a lack of a reliable means for monitoring correct "setup position" and monitoring correct balance during the entire swing. Without a way to monitor correct "setup" and "balance", most students fail to practice them correctly to develop the correct and necessary muscle-memory. Instead they develop bad muscle-memory.

U.S. Pat. No. 5,603,617 of Bergman describes a practice mat for golfers that indicates the suggested placement of the feet of a golfer and a golf ball to be hit, the proper alignment of a golf club in relation to the feet of the golfer and the golf ball, and the suggested direction of travel of the head of the golf club. The mat has a plurality of outlines in the shape of a foot to indicate the suggested foot placement based on the chosen golf club. Also, numerous rectangles are indicated on the mat for placement of the golf ball based on the chosen golf club. However, the practice mat of Bergman does not provide a means for the user to monitor and isolate any position of their body during swinging of a golf club, nor does it aid in prohibiting a golfer from introducing excessive motion sideways, up or down into their technique.

U.S. Pat. No. 5,603,617 of Light shows a sports training device having a full length mirror to reflect the image of a user and a combined television monitor and video cassette player to depict the optimal positioning and technique of a participant in the selected sports activity. Thus, a golfer could view their image in the mirror while watching a monitor below the mirror show the proper way to swing a golf club. This device does not teach proper foot positioning or proper club alignment for swinging a club, nor does it provide a means for a golf instructor to designate as such. It is also doubtful that a user of the device could view a monitor showing an ideal golf swing while observing their own swing in a full length mirror. Further, the large mirror size and lack of proper indicia would not allow the device to properly isolate a golfer's excessive motion sideways, up or down to enable correction of a flawed golf club swing. This device also lacks convenient portability.

U.S. Pat. No. 4,181,307 of Krene describes a golf training device comprising a platform on which a golfer stands, a platform upon which a golf ball placement indicating means is located, and a mirror located between the two platforms to enable the user to see their golf club swing as they hit the golf ball located on the adjacent platform. The device comprises three units that are hinged together along longitudinal edges and the mirror is swivably mounted in a frame such that the angle of tilt of the mirror can be adjusted. However, Krene does not teach a device that can be used in conjunction with golf instruction having indicating means capable of being adjusted to tailor such a device to the needs of a specific golfer. Not only are the foot placement and ball placement means not adjustable in position or angle depending on the needs of a particular user, only the angle, and not the position of the mirror can be adjusted. Thus, depending on the user's physical size, skills, or other factors, the mirror would have no way of being properly positioned such that the user could observe the proper features of their swing to identify excessive lateral and/or vertical motion. Such a mirror in the Krene invention is also excessively large and has longitudinal lines that would be ineffective at isolating a small portion of a user's swing, again preventing the user from pinpointing excessive lateral and/or vertical motion in their swing. Further, a user of the Krene device could not accurately view a small portion of their image while focusing on a golf ball to be hit off of a platform adjacent to the mirror.

As an improvement over these methods and devices of instruction, it would be desirable to have a device and instruction kit that would ideally be used along with proper professional golf lessons. The device would have indicating means that can be adjusted by a instructor to ensure each individual user observed proper positioning form when preparing to swing a golf club. Such a device should also allow the user to monitor and isolate a specific component of their swing, namely excessive motion sideways, up or down, (i.e. lateral and vertical motion) whether in the company of an instructor or not, to ensure that proper technique is being used. A further benefit of such a device would be portability such that the device can be used in either the location where instruction is taking place or wherever the user desires to practice their golf swing. Further, an instruction manual can be provided with the device to enable a golfer to successfully practice their golf club swing frequently at any location to correctly muscle-memorize what a golf instructor taught during each of a series of lessons. Although the concept of a prescribed program of at-home practice in slow motion without a ball is almost totally unused today, new research shows that it was frequently prescribed by the most respected instructors of previous generations. Thus, a combination device and instruction manual would be an addition to the at-home practice prescribed in earlier generations. Making it easy for students to practice and develop muscle-memory "at-home" or away from the formal instructional setting is of great importance because so few students find it possible to take lessons or go to a practice range away from home as often as is necessary to develop accurate and long lasting muscle-memory.

Thus, what is needed is a device that can be used in conjunction with an overall golf instructional program to aid a golfer in developing a proper golf swing. The device would ideally designate proper setup positioning and alignment for a user's feet, hands, head, center of the body and golf club handle position (distance from the body) and the angle of the shaft. A golf ball can be included with the device, and is placed off of the mat in a position that helps the student practice the shaft angle recommended by the instructor. A mirror would also be included with the device to allow the golfers to isolate and monitor the position of their heads, specifically their eyes, while swinging a practice golf club to ensure that head movement does not exceed the instructor's recommendations. Also vitally important to the design of the device is the ability of a golf instructor to adjust the position indicators, the mirror and the golf ball based upon the individual needs of the user, as the muscle flexibility of the golfer increases with practice. Further, an instructional manual can be used in conjunction with the device such that the user is able to properly replicate the skills learned during each lesson taught by the golf instructor and shown in the manual.

SUMMARY OF THE INVENTION

The present invention provides a golf instructional device that designates proper setup positioning for swinging a golf club and allows for monitoring of the location of a user's head while swinging the club when practicing without a ball. The device, or mat, has a surface upon which a user stands and upon which specific foot and club positioning markers, as well as a mirror, are located. The markers and mirror are designed to be removably attached to the mat surface to allow a golf instructor to indicate proper location and angle for the user to position themselves and the club which they are swinging. The mirror is of a chosen size such that when attached to the mat at the proper location, the user can only see their eyes during a substantial part of their golf swing if such a swing demonstrates the proper form to eliminate excessive lateral and/or vertical motion. Additionally, a centering marker and a wedge to be placed under a portion of the user's back foot may be removably attached to the mat surface to further pinpoint the proper setup position of the user and to aid in reducing excessive lateral and/or vertical motion in the user's swing. A loop and toggle device, or other similar closure device, can be provided to allow the mat to be folded and conveniently carried for transporting the mat between the location of golf instruction and another location where the user desires to practice their golf swing. An instructional manual can also be provided to allow the students to, in conjunction with the positioning markers and mirror as arranged by a golf instructor on the mat, replicate the skills learned in a golf lesson at any location the user desires. Further, the manual could be used as a tool to reinforce a proper golf club swing after the user has learned how to "muscle-memorize" or develop good habits with the device.

The golf instruction device and instruction manual of the present invention work together to increase the permanency and speed of teaching and learning a fundamentally correct golf swing. The mat both permits an instructor to designate customized and correct pre-swing setup positioning for the student, and permits the student to monitor the correctness of certain critical segments of the swing when practicing alone at home. The instruction manual describes and illustrates the pre-swing setup and the swing steps the instructor teaches in a series of lessons which the student practices "at-home". The "at-home" practice is ideally in slow-motion without a ball. The practice is effective with a regular length club or with an indoor short club used where swing space is limited. The lessons in the manual are organized to conform with what the instructor teaches in each of the series of instructor-conducted lessons. The lessons are also organized so the student develops good muscle-memory in stages without simultaneously developing bad muscle-memory.

It is therefore an object of the present invention to provide: a golf instructional device that is easily adjustable to allow the designation of proper setup positioning depending on the needs of a particular user. It is a further object of the present invention to provide such a device that allows the user to specifically and reliably monitor excessive lateral and/or vertical motion in their golf club swing. It is yet another object of the present invention to provide such a device that allows the user to implement training tools learned from a golf instructor outside of a structured practice session and in any location the user desires, such a device being lightweight, durable, simple to use and conveniently portable.

Other advantages and components of the present invention will become apparent from the following description taken in conjunction with the accompanying drawings, which constitute a part of this specification and wherein are set forth exemplary embodiments of the present invention to illustrate various objects and features thereof.

DETAILED DESCRIPTION OF THE INVENTION

Figure 1:
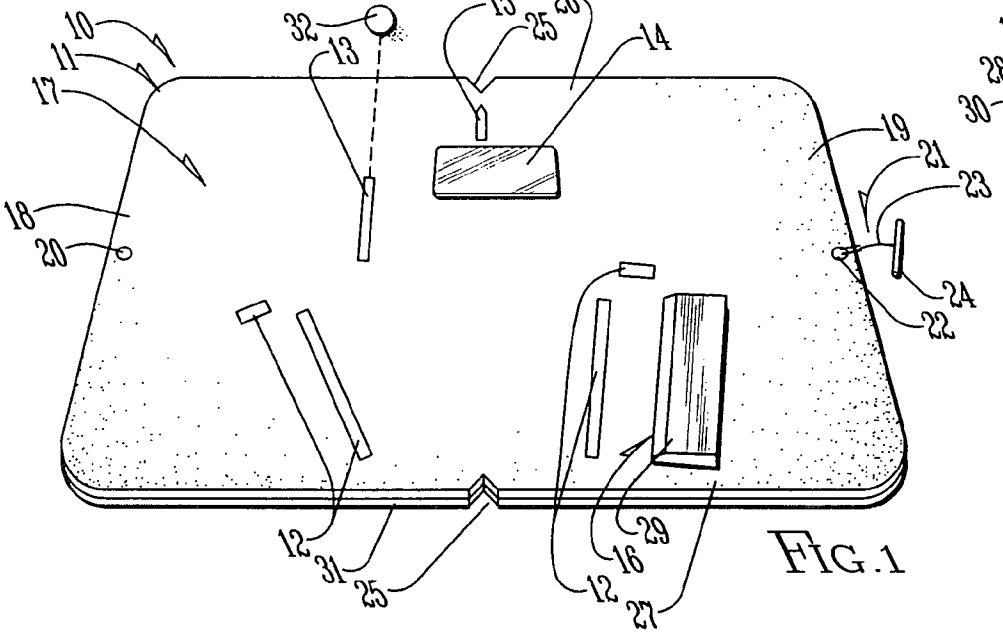
FIG. 1 is a perspective view of a golf instructional device according to the present invention.
Figure 2:
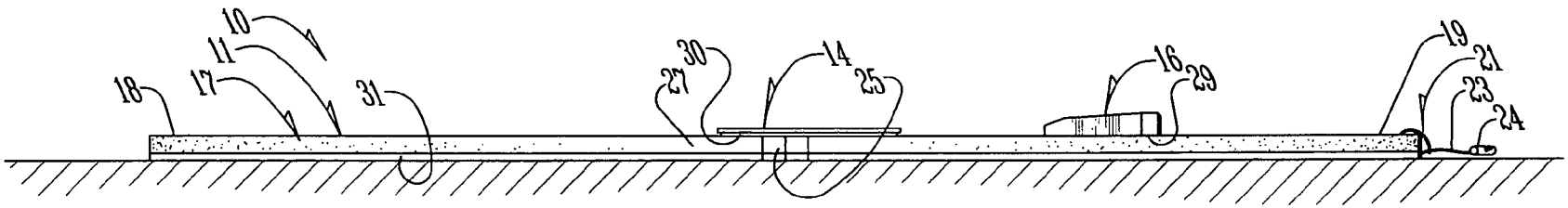
FIG. 2 is a front elevational view of the golf instructional device according to the present invention.
Figure 5:
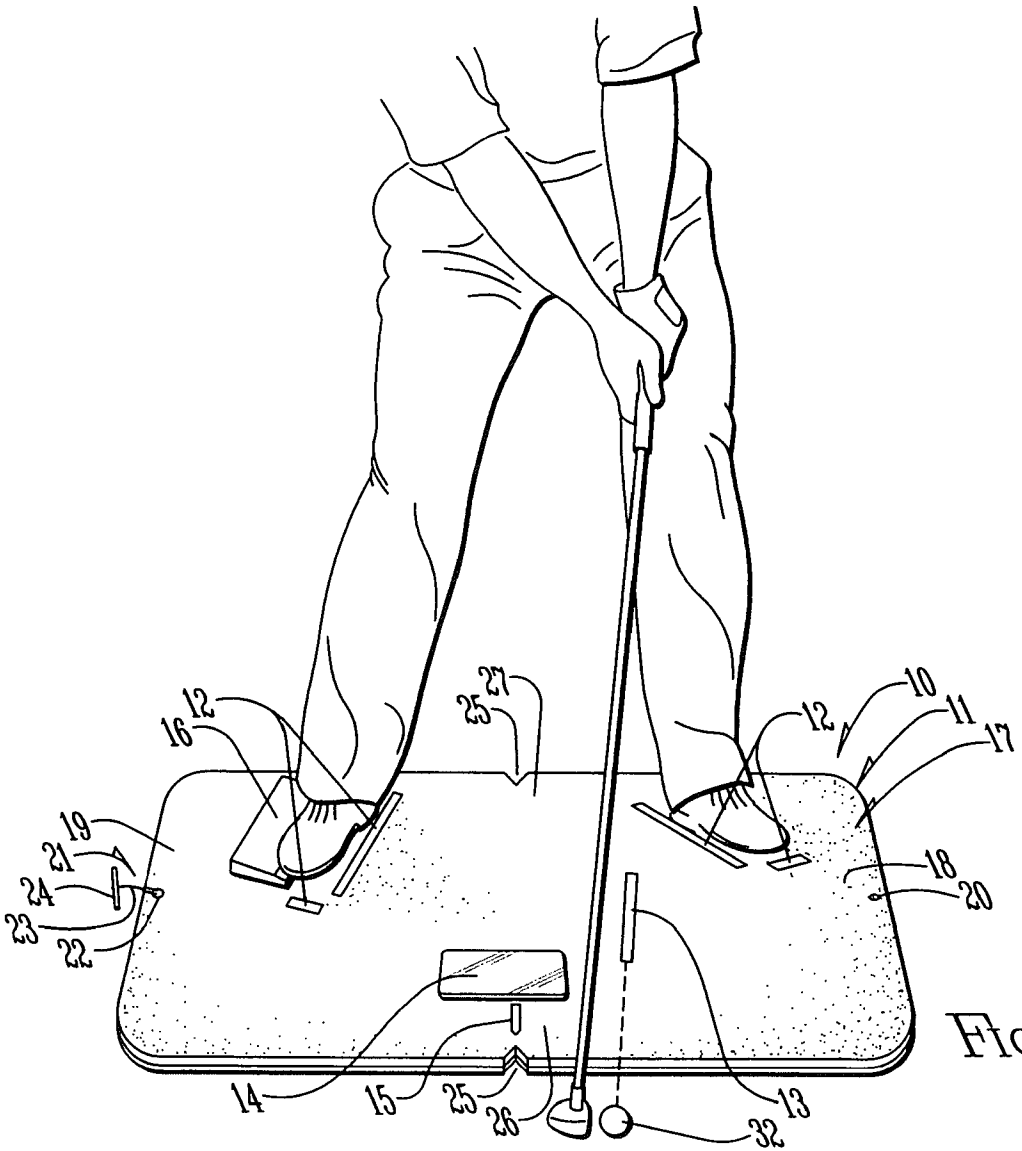
FIG. 5 is a perspective view of the golf instructional device according to the present invention showing one of the positions a right-handed golfer may assume in golf club swing training.

Referring now to the drawings, FIG. 1 shows a golf instructional device 10 in accordance with the present invention. The instructional device 10 consists generally of a support mat 11, one or more foot positioning markers 12, a club positioning marker 13, and a mirror 14 cooperating to permit and instructor to designate the proper setup positioning for a student to practice swinging a golf club and to allow the user to monitor the location of their eyes until a simulated post-impact position is reached. In the preferred embodiment, the present invention also includes a centering marker 15 to designate a reference point for positioning the user's body on the support mat 11 and a wedge 16 adapted to be placed under a portion of the user's foot most rearward in the direction of the golf ball flight.

The support mat 11 has a top surface 17, a bottom surface 31, a first end 18 and a second end 19, and provides a stable, yet flexible surface upon which an individual can stand to swing a golf club and upon which the other components of the present invention are securely placed. The mat 11 is of a sufficient size as to accommodate golfers of various sizes and to allow adequate room for adjustments of the positioning and monitoring components for such golfers. Typically, a mat 11 of about three feet in the length and two feet in width would be sufficient. Also, because there is no need for the mat 11 to be rigid, as the mat 11 is typically placed on a level, solid surface such as pavement or the ground, the mat 11 does not have to be very thick. The mat 11 should have a thickness of at least ¼ of an inch, preferably more. However, for the embodiment of the current invention where the mat 11 can be folded, the mat should not be so thick as to prevent it from being folded with minimal physical effort. The bottom surface 31 is preferably made from abrasion resistant materials that also have high frictional properties such that the mat 11 does not easily slide across a surface. The top surface 17 must be made of materials that are sufficiently durable as to withstand extended use with any type shoe, including golf shoes with spikes. Preferably the top surface 17 of the mat 11 is made of a fabric material that will allow for attachment of the hook component of a hook and loop fastener system, such as that sold under the trade name VELCRO®. In this configuration, the top surface 17 serves as the loop component of the hook and loop system. This design would allow for easy removal and readjustment of any of the components upon which the hook mechanism is secured. However, any system known in the art for removably attaching components to a support mat can also be utilized.

Figure 4:
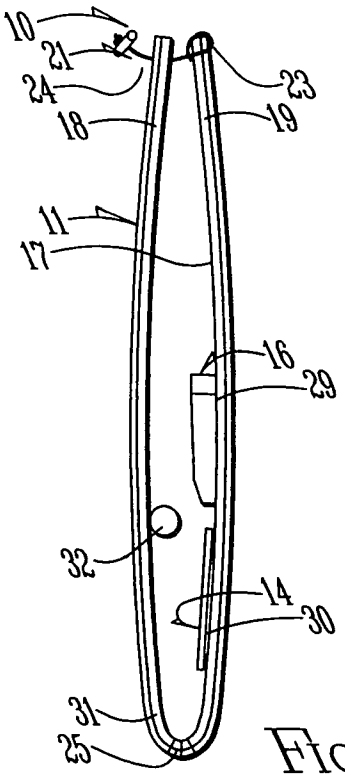
FIG. 4 is a front elevational view of the golf instructional device according to the present invention showing the mat in the folded position and secured by a closure mechanism.
Figure 6:
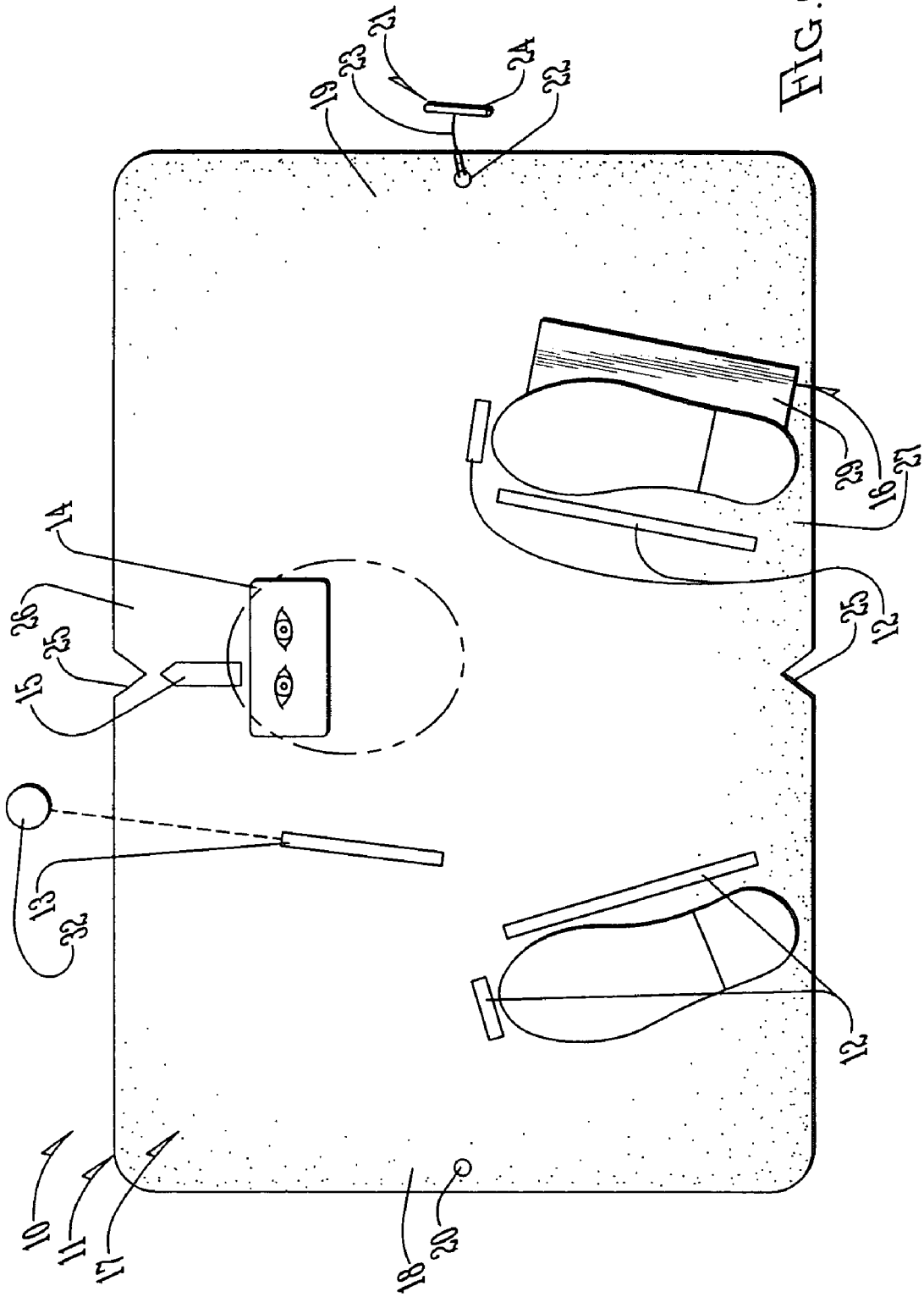
FIG. 6 is a top plan view of the golf instructional device according to the present invention showing a golfer observing his eyes in the mirror.

In the preferred embodiment of the present invention, the first end 18 of the support mat 11 has a first hole 20 for receiving a closure mechanism 21 attached to the second end 19 of the mat 11 through second hole 22. The closure mechanism 21 consists generally of a cord 23 looped through the second hole 22 and secured to a cylindrically-shaped wood toggle 24. In addition to wood, the toggle 24 may be fabricated from plastic or any other material known in the art to be sufficiently lightweight and durable for acting as a handle in carrying the instructional device 10. When the user desires to transport the instructional device 10 to another location, the support mat 11 can be folded in half such that the first and second holes 20 and 22 are substantially aligned. The user then inserts the toggle 24 through the first hole 20 to secure the mat 11 in the folded position and can use the toggle 24 as a handle for carrying the instructional device 10, as shown in FIG. 4. Although a toggle mechanism is shown, any closure mechanism for coupling the first end 18 and second end 19 of the mat 11 together to fold the mat may be used, such as a snap-type closure or fabric loop, or any method known in the art for securing two flexible ends of an object together. The flexible nature of the support mat 11 also allows for easy folding and portability of the present invention.

The foot positioning markers 12, the club positioning markers 13, and the centering marker 15 are formed from the hook component of a hook and loop fastener system, and can be removably attached to the top surface 17 of the support mat 11. The markers 12, 13 and 15 are also generally rectangular in shape, but can be of any shape or configuration known in the art to designate the proper positioning for a golfer to swing a golf club. However, any material known in the art for removably attaching components to a support mat can also be utilized for the markers. The markers can also be formed from other materials such as cloth, metal, wood or synthetics, with the hook component of a hook and loop system attached to the underside of the marker.

The centering marker 15 is generally rectangular in shape with a pointed end to designate a position on the top surface about which the user will center their body when preparing to swing a golf club. This is necessary because when the mat 11 is folded in half for transporting, the mirror 14 must be repositioned off the folded seam. V-shaped notches 25 can be cut into the forward 26 and rearward 27 edges of the support mat 11 to serve the purpose of permanently designating a centering position for the user. However, other markers, such as studs, can be used as an alternative to the v-shaped notches 25 so long as they would securely and permanently designate the centering position for the user.

A foot positioning marker 12 is supplied for each of the user's left and right feet. The marker 12 is generally rectangular in shape and of a sufficient size to allow a golf instructor to designate the proper position and angle of the markers 12 for each foot based on the individual needs of the user. The angles of the feet, which are positioned according to the foot markers, can affect how far the hips can rotate, which can affect the length of the golf club's swing path. The user will align the inside of each shoe sole immediately adjacent to the respective marker 12. The marker 12 can also include right angle marks to show the proper toe placement positions of the user's foot along with the angle of alignment of the foot. The position and angle of the foot positioning markers 12 will often be changed by a golf instructor as the user's flexibility increases with practice. It is possible to have a single positioning marker for either the user's left or right foot, but ideally, the positions of both feet should be designated on the mat by an instructor to assure the best setup positioning for swinging a golf club.

In the preferred embodiment of the present invention, a wedge 16 is placed behind the most rearward foot positioning marker 12 of the user (i.e. behind the right foot marker of a right-handed golfer or behind the left foot marker of a left-handed golfer). The wedge 16 is generally rectangular in shape with a sloped or rounded edge along one of its longitudinal sides and is ideally aligned with the adjacent rearward foot positioning marker 12. The wedge can be made of wood or synthetic materials that are sufficiently strong to support a portion of the weight of a user, whether applied by flat soled shoes or golf spikes. To utilize the wedge 16, the user will stand with at least a portion of their rearward foot on top of wedge 16 such that the rearward foot is aligned with the foot positioning marker 12. More specifically, the user places the outside portion of their shoe sole on the wedge 16.

Figure 3:
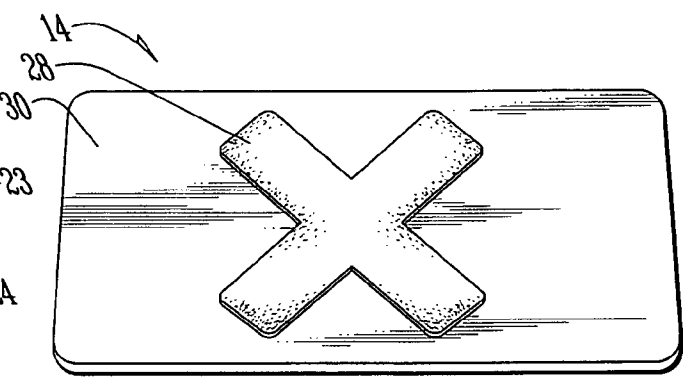
FIG. 3 is a bottom plan view of the mirror component of the present invention showing the representative attachment means used for securing the mirror, the foot positioning marker, the club positioning marker, the golf ball, the wedge and the centering marker to the support mat.

The prime objective of the wedge 16 is to aid in training the golfer to maintain a near-stationary right leg during the entire backswing to enhance control over the user's "sway" in the rearward direction of swing. Additionally, maintaining a stationary right leg during the backswing generates great pressure in the right leg. When the backswing is completed, the leg pressure is relaxed and an automatic spring-back of the right leg and hips occurs at the start of the downswing. This spring-back effect helps the lower body move forward ahead of the upper body, which invariably forces the golfer to adapt the proper form in swinging a golf club. To allow for removable attachment of the wedge 16 to the top surface 17 of the support mat 11, a hook component 28 of a hook and loop fastener system can be affixed to the bottom surface 29 of the wedge 16, as represented in FIG. 3 for attachment of the hook component 28 to the bottom surface 30 of the mirror 14, such a bottom surface 30 preferably being non-reflective. The hook component 28 can be of any shape to sufficiently secure the wedge 16 to the mat 11.

The club positioning marker 13 is generally rectangular in shape and sufficiently sized as to allow the golf instructor to designate the proper position, angle, and alignment of the golf club shaft held by the user to setup the proper swinging of the club. This also ensures that the golfer's hands are correctly positioned in relationship to their body. A golf ball 32 can also be located off the mat at a position as to designate the proper location of the golf club head before swinging the club. The golf ball 32 can also have the hook component 28 of a hook and loop system attached to a portion of the surface of the ball such that the ball can be attached to the mat 11 when transporting the mat, as shown in FIG. 4. As with the foot positioning marker 12, the marker 13 is positioned by a golf instructor on the mat 11 according to certain individual characteristics of the user.

The mirror 14 is designed to allow the user to view their eyes during the setup and the swing until after impact with the ball. To accomplish this goal, the mirror 14 is sized and configured to be sufficiently small such that when it is placed on the top surface 17 of the mat 11, the user is essentially only able view their eyes. The mirror 14 is preferably rectangular in shape, but can be of any shape as to focus the user's line-of-sight on their eyes in the reflected image, such as round, oblong, or square. Also, the mirror 14 is preferably made of acrylic, but can be formed from any material known to provide a reflective surface. After the instructor sets the positions of the foot positioning markers 12, and the user assumes the proper setup stance on the mat 11, the location of the mirror 14 is set such that the user can view their eyes in the mirror. FIG. 3 shows one embodiment of the hook component 28 of a hook and loop fastener system affixed to the bottom surface 30 of the mirror 14 to allow for removable attachment of the mirror to the top surface 17 of the support mat 11. During the backswing and forward swing up until after impact, or simulated impact, the user can look into the mirror 14 and notice whether there is excessive movement of their eyes. Because the mirror 14 is sufficiently small as to isolate the eyes, the user has a simple reference point for observing excessive lateral or vertical motion during practice swings: if the user is unable to observe their eyes in the mirror 14 at any point until after the club head passes the position it would to hit a ball, because the eyes have move out of the line-of-sight of the mirror reflection, then there is excessive movement that can be addressed. Depending on the size, ability and flexibility of the user, the mirror 14 may be positioned on the surface 17 of the mat 11 such that it is either closer to, or farther from, the foot positioning markers 12 as is the club positioning marker 13. Also, as with the other markers 12 and 13, the position of the mirror 14 can be changed by a golf instructor as the user's skill and/or flexibility increases with practice. Additionally, mirror positioning markers can be used to designate the proper position for the mirror 14 on the mat 11. Preferably, the mirror positioning markers comprises two rounded hook component dots that are removably attached to the mat at positions as to designate placement of the mirror 14 on the mat 11 between the dots.

After the user has practiced their golf club swing with the golf instructional device 10 in a setting where a golf instructor has correctly positioned the components of the device, the user can take the device 10 to another location, such as at home, and in conjunction with the lessons detailed in an instructional manual (not shown), practice their swing technique outside of a formal instructional setting. The instruction manual typically takes the form of a paper notebook, but could be in any form that manuals are currently kept, or will be in the future, such as on a CD-ROM or any other media storage form, such that the teachings of the manual can be accessed by the golfer from any location and with any device, such as a computer, personal digital assistant, or similar electronic device. Because the position of the markers 12, 13 and 15, the mirror 14, and the wedge 16 on the mat 11 has been set by the instructor, and the lessons learned in the instructional setting are reiterated in the instructional manual, the user can repeat their golf swing in proper form according to the instructor's teachings and develop good habits. Over a period of time, or upon advancements in technique or flexibility observed by a golf instructor, the instructor can change the position and angle of the components of the present invention to further develop the proper form of the user's golf swing. This method of instruction provides a great advantage over the prior art because the device can be arranged such that the user is required to "muscle memorize" one component of a proper club swing technique at a time, leaving no room for developing bad swing habits along with desired habits.

As mentioned above, the instructional device 10 can be used in conjunction with the instructional manual to give the user further guidance in reinforcing a specific swing or "muscle memory" technique outside of the instructional setting. The manual is divided into sections to correspond with specific techniques taught during each instructional lesson. Ideally, the student learns and practices the contents of one lesson at a time in an instructional setting with a golf instructor, and the device 10, before the student uses the device 10 and instructional manual to practice alone at-home or other setting without the instructor. In this way, each individual section of the manual is not read by the user until the golf instructor directs them to do so. This ensures that the user begins to "feel" the proper swing technique when developing their swing by using the device 10 and instructional manual in conjunction with one another.

The combination of using the instructional manual with the instructional device 10 provides guidance to golf instructors on what and how to teach proper golf club swinging techniques. It is widely known in the golf industry that the teaching a correct "feel" of how to swing a golf club is very difficult and that neither demonstrations nor words can directly accomplish this goal. Providing an instructional device 10 with a set of instructions for repeating club swing techniques learned in a golf lesson facilitates the user's ability to achieve such a "feel" in their golf game.

Thus, the device 10 and instructional manual work together as follows. First, the instructor uses the mat to indicate the customized-correct pre-swing body and club positions for the student. Second, the instructor teaches the correct swing to the student in a series of lessons. These lessons include teaching the student how, and the importance of, being able to see his/her eyes in the mirror continuously until after the ball has been struck. Because initially the setup position and swinging of a club as taught with the present invention feel somewhat uncomfortable and instinctively wrong to the golfer, the user must practice the setup and swing daily until everything fells comfortable and instinctively right. Most golf students are unsuccessful at developing correct setup, swing and stretching habits because (a) they forget the many important details taught by the golf instructor, and therefore practice incorrectly and develop bad muscle-memory, and (b) they can't practice enough because of the difficulty of getting to a golf practice range. The combination of the device 10 and instructional manual make it possible for golfers to practice often enough and in correct form as to develop good muscle-memory. This is because, as the manual explains and instructs, the user can practice indoors in slow motion, without a ball. The markers on the mat ensure that the user's setup is correct. The mirror 14 ensures that the student learns to swing in balance, and the head doesn't move excessively until after impact. Because the manual describes and illustrates what the instructor taught during each lesson, the student remembers what was taught and is ensured of practicing correctly and developing correct muscle-memory.

From the forgoing information, it should now be obvious that the golf instructional device 10, especially when used in conjunction with the associated instructional manual, provides a training device that can be customized to meet the individual needs of a particular golfer and can more accurately monitor the required fundamentals of a good golf swing. The device or mat 10 is adjusted by a golf instructor to enable a golfer to improve their skills both during formal instruction and during practice sessions where the student is alone, and at any location desired. It is to be understood that the present invention can use other attachment means in addition to those disclosed herein for removably attaching the components of the invention to the support mat 11, as future technologies may be developed to provide a similar function. Furthermore, while certain forms of the present invention have been illustrated and described herein, it is not to be limited to the specific forms or arrangement of parts described and shown.

I claim:

1. A method of using a golf instructional device, said method comprising the steps of:

placing one or more selectively removable and repositionable foot positioning members onto a support mat surface to indicate proper placement of one or more feet of a user for swinging a golf club;

placing a selectively removable and repositionable club positioning member onto the support mat surface to indicate proper pre-swing body and club setup alignment;

placing a mirror adjacent the support mat surface, the minor being sized and configured to indicate and maintain proper positioning of a user's eyes during a golf swing such that excessive movement byte user's head, and thus movement of the line of sight of the user's eves, disrupts the user's vision of the reflection of the user's eves from the mirror; and having a user stand on the support mat surface and align one or more feet with the one or more foot positioning members, position the user's head such that the user can essentially only view their eyes in the mirror, and swing a golf club while the user visually observes any movement of their head in the mirror during at least a portion of the golf club practice swing;

whereby the foot positioning member, the club positioning member and the minor cooperatively provide the user with a properly designated setup position for swinging the golf club.

2. The method of claim 1, further comprising the step of:

adjusting the position of the one or more removable and repositionable foot positioning members, removable and repositionable club positioning member, or mirror on the support mat surface based on either a specific instructional lesson to be taught by a golf instructor, or on changes and/or improvements in the golf club swing of a user, such adjusting performed only by a golf instructor and not byte individual using the mat.

3. The method of claim 1, further comprising the step of:

providing the user with an instructional manual containing teaching methods corresponding to specific lessons taught by a golf instructor, such teachings arranged within the manual in a manner as to facilitate the user reinforcing specific pre-swing setup positioning and club swing techniques learned with the instructional device outside the presence of the golf instructor.

4. A method of providing golf instruction, said method comprising the steps of:

providing a user with an instructional device having selectively removable and repositionable markers for designating proper setup positioning and stance for the user to swing a golf club, the positioning being customized and markers being adjustable for an individual user, the markers including at least one removably positionable foot positioning marker and at least one removably positionable club positioning marker;

positioning a user in a proper stance by having a golf instructor position the selectively removable and repositionable markers on the device in such locations as to teach the user a proper setup position for swinging a golf club; and providing a mirror with the instructional device for monitoring the location of a user's eyes while swinging the golf club, the mirror being configured and positioned such that excessive movement by the user's head, and thus movement of the line of sight of the user's eyes, disrupts the user's vision of the reflection of the user's eyes from the mirror:

whereby the foot positioning marker, the club positioning marker and the mirror cooperatively provide the user with a properly designated setup position for swinging the golf club.

5. The method of claim 4, further comprising the step of:

providing the user with an instructional manual containing teaching methods corresponding to specific lessons taught by the golf instructor, reinforcing a specific user stance and user club swing technique through teachings arranged within the manual outside the presence of the golf instructor, the selectively removable and repositionable markers for designating proper setup positioning and stance for the user to swing a golf club maintaining their positioning during transfer and subsequent setup of the instructional device.

6. A method of providing golf instruction in which a user makes practice golf club swings, comprising the steps of:

placing one or more removably positionable foot positioning markers onto a surface of a support mat to indicate proper positioning and alignment of one or more feet of a user for swinging a golf club;

placing a removably positionable club positioning marker onto the surface of the support mat to indicate proper pre-swing body and club setup alignment of the user;

placing a removably positionable mirror adjacent to the support mat surface sized and configured to indicate to the user a proper positioning of the user's eyes prior to swinging the golf club and during at least a portion of the user's practice swing, whereby excessive movement of the user's head, and thus movement of the user's line of sight disrupts the user's vision of the reflection of the user's eyes from the mirror; and having a user stand on the support mat surface and align one or more feet with the one or more foot positioning markers, align a golf club shaft with the club positioning marker, position the user's head such that the user isolates the reflection of their eyes in the mirror, and swing a golf club while the user visually observes any excessive movement of their eyes in the mirror during at least a portion of the user's practice swing;

whereby the foot positioning marker, the club positioning marker and the mirror cooperatively provide the user with a properly designated setup position for swinging the golf club.

7. The method of claim 6, wherein the steps of placing the one or more removably positionable foot positioning markers onto the support mat surface, placing the removably positionable club positioning marker onto the support mat surface, and placing the removably positionable minor adjacent to the support mat surface are performed by a golf instructor to provide the best body and golf club positioning setup for the user according to the physical characteristics of the user.

8. The method of claim 6, further comprising the step of the golf instructor adjusting the position of at least one of the one or more foot positioning markets, the club positioning marker and minor on the surface of the support mat based on one of:

the golf instructor observing the user's flexibility increase with practice; and the golf instructor observing the user's individual physical swing characteristics becoming apparent when such swing characteristics were not previously apparent.

9. The method of claim 6, wherein the step of the user visually observing any excessive movement of their eyes in the mirror during at least a portion of the user's practice swing comprises the user visually observing any movement of their eyes in the mirror prior to swinging the golf club and during a portion of the user's practice swing through simulated impact with a golf ball.

10. The method of claim 6, further comprising the step of placing a golf ball marker on the support mat to indicate the proper setup position of a golf club head held by the user.

11. The method of claim 6, further comprising the step of placing a wedge onto the surface of the support mat for the user to place one foot thereon to aid in training the user to maintain a near-stationary beck leg during the entire backswing.

12. A method of providing golf instruction, said method comprising the steps of:

providing a user with an instructional device having selectively removable and repositionable markers for designating proper setup positioning and stance for the user to swing a golf club, the positioning being customized and markers being adjustable for an individual user, the markers including at least one removably positionable foot positioning marker and at least one removably positionable club positioning marker;

providing a minor with the instructional device for monitoring the location of a user's eyes while making practice swings with the golf club;

positioning a user in a proper stance by having a golf instructor position the selectively removable and repositionable markers on the device in such locations as to teach the user a proper setup position for swinging a golf club, having a golf instructor position the mirror adjacent the device in such a location as to teach the user to maintain the stance and a near-steady head while making practice swings with the golf club, the mirror being sized and configured such that an incorrect stance or excessive movement of the user's head will cause the user to not see his eves' reflection;

providing the user with an instructional manual containing teaching methods corresponding to specific lessons taught by the golf instructor, and reinforcing a specific user stance and user club swing technique through teachings arranged within the manual outside the presence of the golf instructor, the selectively removable and repositionable markers for designating proper setup positioning and stance for the user to swing a golf club maintaining their positioning during transfer and subsequent setup of the instructional device;

whereby the foot positioning marker, the club positioning marker and the mirror cooperatively provide the user with a properly designated setup position for swinging the golf club.

* * * * *

UNITED STATES PATENT AND TRADEMARK OFFICE

CERTIFICATE OF CORRECTION

PATENT NO. : 7,112,144 B2
APPLICATION NO. : 10/684609
DATED : September 26, 2006
INVENTOR(S) : Richard B. Mindlin It is certified that error appears in the above-identified patent and that said Letters Patent is hereby corrected as shown below:

Title Page, Item (57)

Abstract: Last Sentence, insert --with-- between “swings” and “the”.

Column 3: Line 36, replace “swinging a practice” with --making a practice swing with a--.

Column 9: Line 66, replace “minor” with --mirror--.

Column 10: Line 1, replace “byte” with --by the--.
Line 13, replace “minor” with --mirror--.
Line 24, replace “byte” with --by the--.

Column 11: Line 37, replace “minor” with --mirror--.

Column 12: Line 11, replace “beck” with --back--.
Line 23, replace “minor” with --mirror--.
Line 37, replace “eves” with --eyes--.

Signed and Sealed this

First Day of May, 2007

JON W. DUDAS
*Director of the United States Patent and Trademark Office*